US012677945B2

(12) United States Patent
Chen et al.

(10) Patent No.: US 12,677,945 B2
(45) Date of Patent: Jul. 14, 2026

(54) SLIDE RAIL ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Wei-Chen Chang, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 279 days.

(21) Appl. No.: 18/621,041

(22) Filed: Mar. 28, 2024

(65) Prior Publication Data

US 2025/0089891 A1 Mar. 20, 2025

(30) Foreign Application Priority Data

Sep. 20, 2023 (TW) ..... 112136067

(51) Int. Cl.
*A47B 88/44* (2017.01)
*A47B 88/473* (2017.01)
*A47B 88/483* (2017.01)

(52) U.S. Cl.
CPC ..... *A47B 88/44* (2017.01); *A47B 88/473* (2017.01); *A47B 88/483* (2017.01)

(58) Field of Classification Search
CPC ..... A47B 88/44; A47B 88/473; A47B 88/483; A47B 2210/0016; A47B 88/57; H05K 7/1489
See application file for complete search history.

(56) References Cited

U.S. PATENT DOCUMENTS 6,367,899 B1 * 4/2002 Hwang ..... A47B 88/57 312/334.47
6,375,290 B1 * 4/2002 Lin ..... A47B 88/49 312/334.44

(Continued)

FOREIGN PATENT DOCUMENTS

CN 113323517 A * 8/2021 ..... E05C 3/162
CN 114847691 A * 8/2022 ..... A47B 88/49

(Continued)

*Primary Examiner* — Hanh V Tran
(74) *Attorney, Agent, or Firm* — Winston Hsu

(57) ABSTRACT

A slide rail assembly is provided and includes a first rail, a second rail, a blocking feature, an engaging member and an operating member. The second rail is displaceable relative to the first rail along a longitudinal direction. The blocking feature is arranged on the first rail. When the second rail is located at a predetermined position relative to the first rail, the blocking feature blocks the engaging member for preventing a displacement of the second rail from the predetermined position along a first direction. The operating member is configured to drive the engaging member, such that the engaging member is not blocked by the blocking feature for allowing the displacement of the second rail from the predetermined position along the first direction.

19 Claims, 6 Drawing Sheets

(56) References Cited

U.S. PATENT DOCUMENTS

| | | | | |
|---|---|---|---|---|
| 6,412,891 | B1 * | 7/2002 | Liang | A47B 88/487 312/334.44 |
| 6,851,774 | B2 * | 2/2005 | Chen | A47B 88/497 312/334.47 |
| 7,101,081 | B2 * | 9/2006 | Chen | A47B 88/493 312/334.46 |
| 8,385,076 | B2 * | 2/2013 | Peng | H05K 7/1401 361/740 |
| 8,616,662 | B2 * | 12/2013 | Yin | H05K 7/1489 361/679.33 |
| 8,733,864 | B2 * | 5/2014 | Chen | A47B 88/493 312/334.45 |
| 9,161,626 | B2 * | 10/2015 | Zimmermann | A47B 88/493 |
| 9,408,462 | B1 * | 8/2016 | Hong | F24C 15/168 |
| 9,445,671 | B2 * | 9/2016 | Ng | E05C 3/22 |
| 9,629,459 | B2 * | 4/2017 | Chen | A47B 88/427 |
| 9,861,196 | B2 * | 1/2018 | Chen | A47B 88/50 |
| 9,980,565 | B2 * | 5/2018 | Chen | A47B 88/483 |
| 10,098,459 | B2 * | 10/2018 | Chen | A47B 96/067 |
| 10,362,870 | B1 * | 7/2019 | Smith | A47B 88/407 |
| 10,383,248 | B1 * | 8/2019 | Chen | H05K 7/18 |
| 10,631,639 | B2 * | 4/2020 | Chen | H05K 7/1489 |
| 11,143,237 | B2 | 10/2021 | Chen | |
| 11,197,389 | B2 * | 12/2021 | Lin | A47B 88/437 |
| 11,375,811 | B2 * | 7/2022 | Chen | A47B 88/43 |
| 11,864,336 | B2 * | 1/2024 | Tan | H05K 7/1489 |
| 12,390,008 | B2 * | 8/2025 | Chen | A47B 88/443 |
| 12,440,026 | B2 * | 10/2025 | Chen | A47B 88/49 |
| 12,550,277 | B2 * | 2/2026 | Lin | H05K 7/1401 |
| 2017/0099946 | A1 | 4/2017 | Chen | |
| 2018/0202490 | A1 * | 7/2018 | Chen | F16C 29/10 |
| 2019/0045924 | A1 | 2/2019 | Chen | |
| 2021/0145174 | A1 | 5/2021 | Chen | |
| 2022/0192376 | A1 * | 6/2022 | Chen | A47B 88/57 |
| 2022/0369478 | A1 * | 11/2022 | Li | H05K 7/20272 |
| 2023/0157451 | A1 * | 5/2023 | Flagin | A47B 88/57 312/330.1 |
| 2024/0240669 | A1 * | 7/2024 | Chen | A47B 88/423 |
| 2024/0244785 | A1 * | 7/2024 | Chuang | H05K 7/1489 |

FOREIGN PATENT DOCUMENTS

| | | | | |
|---|---|---|---|---|
| EP | 3144457 | A1 * | 3/2017 | H05K 7/1489 |
| JP | H0165185 | U * | 4/1989 | |
| JP | 2018-114264 | A | 7/2018 | |
| JP | 2019-181148 | A | 10/2019 | |
| JP | 2020-58775 | A | 4/2020 | |

* cited by examiner

SLIDE RAIL ASSEMBLY

BACKGROUND OF THE INVENTION

1. Field of the Invention

The present invention relates to a slide rail product, and more specifically, to a slide rail assembly for terminating a blocking relation between two rails by utilizing an operating member.

2. Description of the Prior Art

In U.S. Pat. No. 10,631,639 B2, it discloses a slide rail assembly including a first rail, a second rail, a blocking member and an operating member. The blocking member is attached on the first rail. The operating member can be in a predetermined state relative to the second rail. The operating member includes a handle portion. When the second rail is located at a retracted position relative to the first rail, the handle portion protrudes from a first end portion of the first rail at a predetermined distance. The operating member in the predetermined state is blocked by the blocking member for preventing a displacement of the second rail from the retracted position along a first direction. When the handle portion of the operating member is operated to move the operating member away from the predetermined state, the operating member is not blocked by the blocking member for allowing the displacement of the second rail from the retracted position along the first direction.

However, in order to meet various requirements, it becomes an important topic to provide an alternative solution for terminating a blocking relation between different rails with easy operation.

SUMMARY OF THE INVENTION

The present invention is to provide a slide rail assembly for terminating a blocking relation between two rails by utilizing an operating member.

According to aspect of the present invention, a slide rail assembly slide rail assembly includes a first rail, a second rail, a blocking feature, an engaging member, a resilient member and an operating member. The second rail is displaceable relative to the first rail along a longitudinal direction. The second rail includes a first end portion and a second end portion opposite to the first end portion along the longitudinal direction. The blocking feature is arranged on the first rail. The resilient member is configured to provide a resilient force to the engaging member. The operating member is located between the first end portion and the second end portion of the second rail along the longitudinal direction and located adjacent to a lateral side of the second rail. The operating member is movably switchable between a first state and a second state. When the second rail is located at a retracted position relative to the first rail, the blocking feature blocks the engaging member applied with the resilient force provided by the resilient member for preventing a displacement of the second rail from the retracted position along a first direction. The operating member is configured to move from the first state to the second state to drive the engaging member, such that the engaging member is not blocked by the blocking feature for allowing the displacement of the second rail from the retracted position along the first direction.

According to aspect of the present invention, a slide rail assembly includes a first rail, a second rail, a blocking feature, an engaging member and an operating member. The second rail is displaceable relative to the first rail and configured to support a carried object. The blocking feature is arranged on the first rail. The engaging member is movable relative to the first rail. The operating member is movably mounted on one of the second rail and the carried object. The operating member is movably switchable between a first state and a second state. When the second rail is located at a predetermined position relative to the first rail, the engaging member is blocked by the blocking feature for preventing a displacement of the second rail from a predetermined position along a first direction. The operating member is configured to move from the first state to the second state to drive the engaging member, such that the engaging member is not blocked by the blocking feature for allowing the displacement of the second rail from the predetermined position along the first direction.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
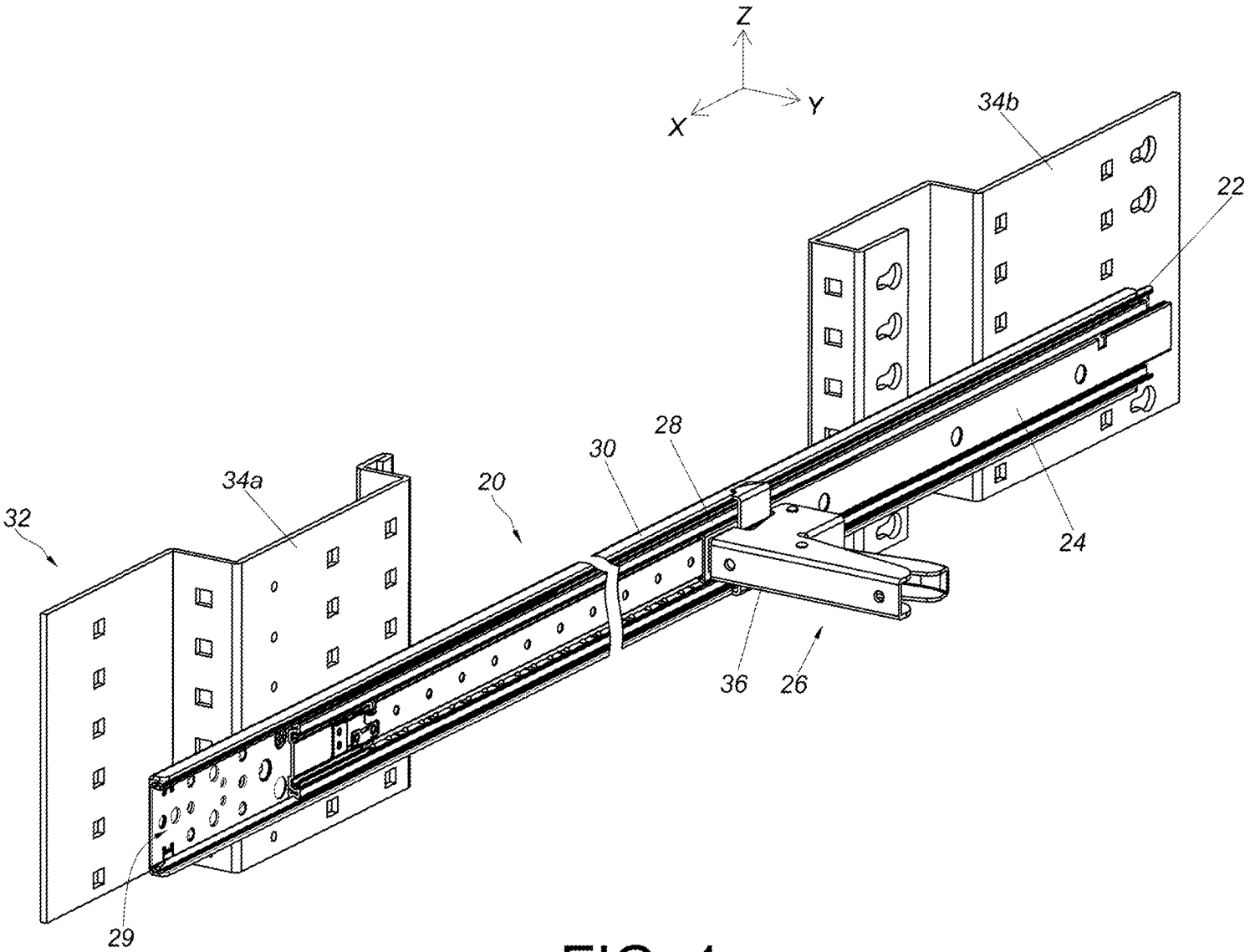
FIG. 1 is a diagram of a slide rail assembly according to a first embodiment of the present invention.
Figure 2:
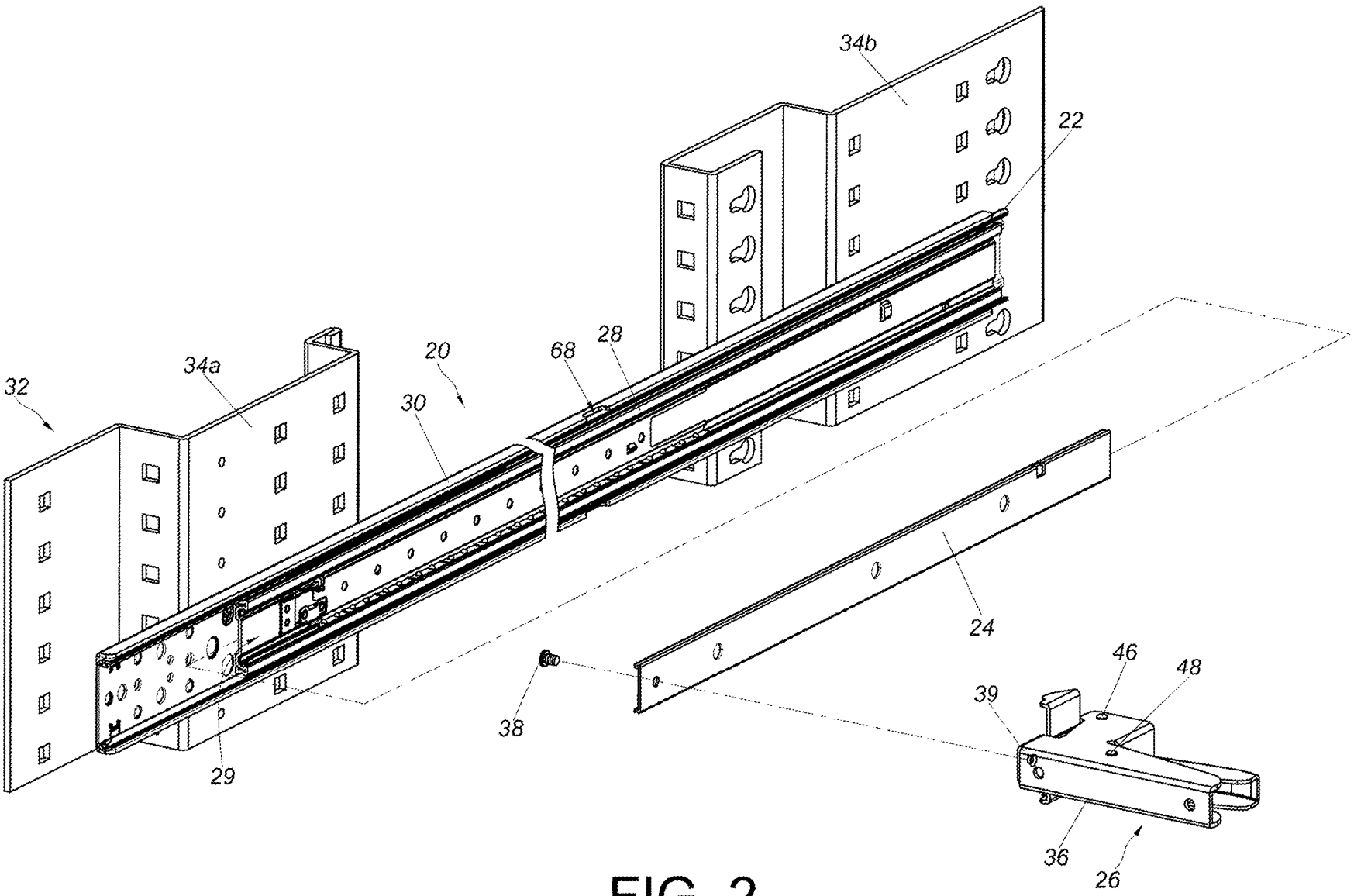
FIG. 2 is an exploded diagram of the slide rail assembly according to the first embodiment of the present invention.

As shown in FIG. 1 and FIG. 2, in a first embodiment, a slide rail assembly 20 includes a first rail 22, a second rail 24 and an operating device 26. The second rail 24 is displaceable relative to the first rail 22 along a longitudinal direction. In this embodiment, by way of example, the longitudinal direction can be defined by a length direction or a displacing direction of a slide rail, e.g., the second rail 24, and parallel to an X axis. A transverse direction can be defined by a lateral direction or a width direction of the slide rail and parallel to a Y axis. The vertical direction can be defined by a height direction of the slide rail and parallel to a Z axis.

Preferably, as shown in FIG. 2, the slide rail assembly 20 further includes a third rail 28 movably mounted between the first rail 22 and the second rail 24. In this embodiment, by way of example, the second rail 24 is movably mounted on a channel 29 of the third rail 28.

Preferably, the slide rail assembly 20 further includes a supporting bracket 30 arranged on the first rail 22 and configured to be mounted on a rack 32, e.g., a first post 34*a* and a second post 34*b* of the rack 32. Furthermore, the supporting bracket 30 is connected, e.g., fixedly connected, to the first rail 22, and therefore the supporting bracket 30 can be considered as a part of the first rail 22.

The operating device 26 includes an auxiliary member 36. In this embodiment, by way of example, the auxiliary member 36 is configured to be mounted on the second rail 24, and the auxiliary member 36 can be immovable relative to the second rail 24 so as to be considered as a part of the second rail 24 after the auxiliary member 36 is mounted on the second rail 24. As shown in FIG. 2, the auxiliary member 36 is detachably mounted on the second rail 24 by at least one connecting member 38 in a fastening manner. However, the present invention is not limited to this embodiment. For example, in another embodiment, the auxiliary member can be detachably mounted on the second rail in an engaging manner, an inserting manner, a snapping manner or any other manner.

Figure 3:
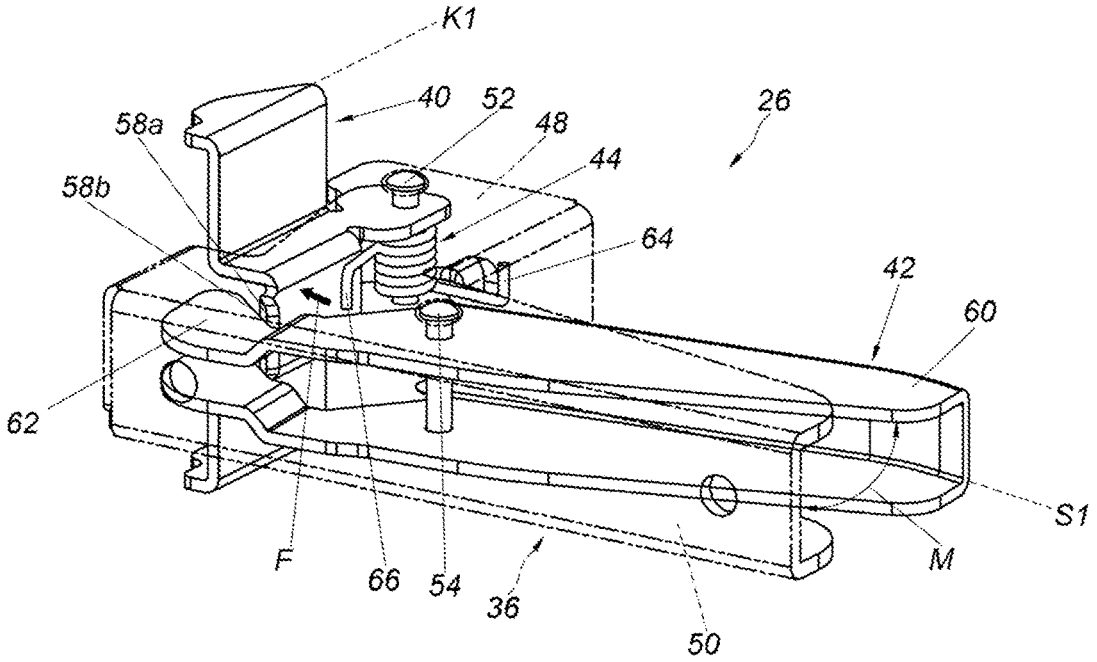
FIG. 3 and FIG. 4 are diagrams of an operating device at different views according to the first embodiment of the present invention.
Figure 4:
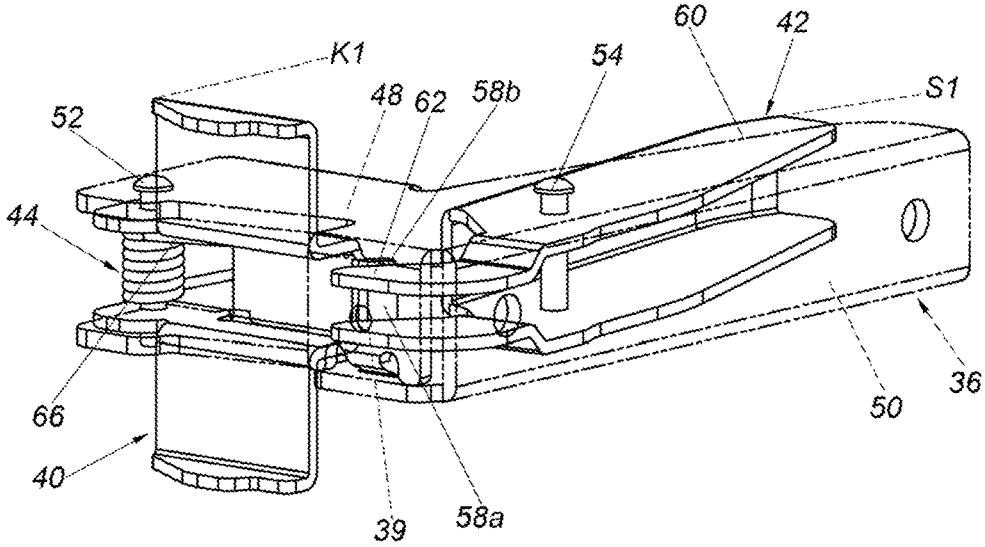

As shown in FIG. 3 and FIG. 4, the auxiliary member 36 includes a predetermined feature 39 configured to cooperate with the connecting member 38. In this embodiment, by way of example, the predetermined feature 39 is a hole, e.g., a threaded hole, for allowing the connecting member 38 to pass therethrough. However, the present invention is not limited to this embodiment. Furthermore, the operating device 26 further includes an engaging member 40 and an operating member 42. Preferably, the operating device 26 further includes a resilient member 44.

The resilient member 44 is configured to provide a resilient force F to the engaging member 40. The operating member 42 is configured to operate the engaging member 40.

Preferably, one of the engaging member 40 and the operating member 42 is movably mounted on the auxiliary member 36. In this embodiment, by way of example, the engaging member 40 and the operating member 42 are both movably mounted on the auxiliary member 36.

Preferably, the auxiliary member 36 includes a first predetermined portion 48 and a second predetermined portion 50 connected to the first predetermined portion 48. In this embodiment, by way of example, the first predetermined portion 48 and the second predetermined portion 50 are substantially perpendicularly connected to each other and respectively extend along the longitudinal direction and the transverse direction. However, the present invention is not limited to this embodiment. Besides, the operating member 42 is pivotally connected to the second predetermined portion 50 by a first shaft member 54, and the engaging member 40 is pivotally connected to the first predetermined portion 48 by a second shaft member 52.

Preferably, the engaging member 40 can be retained in an engaging state K1 in response to the resilient force F provided by the resilient member 44. When the engaging member 40 is in the engaging state K1, the operating member 42 is in a first state S1.

Preferably, the engaging member 40 in the engaging state K1 is configured to abut against the operating member 42 for retaining the operating member 42 in the first state S1.

Preferably, one of the engaging member 40 and the operating member 42 includes at least one guiding feature, e.g., an inclined surface or an arc surface. In this embodiment, by way of example, the engaging member 40 includes a first guiding feature 58*a*, and the operating member 42 includes a second guiding feature 58*b* corresponding to the first guiding feature 58*a*. However, the present invention is not limited to this embodiment. The engaging member 40 in the engaging state K1 is configured to retain the operating member 42 in the first state S1 by an abutment of the first guiding feature 58*a* and the second guiding feature 58*b*.

Preferably, the operating member 42 includes an operating portion 60 and a driving portion 62. The first shaft member 54 is located between the operating portion 60 and the driving portion 62. The second guiding feature 58*b* is arranged on the driving portion 62. Besides, when the operating member 42 is in the first state S1 as shown in FIG. 3, the operating portion 60 of the operating member 42 extends along the transverse direction and is spaced away from the second predetermined portion 50 of the auxiliary member 36 at a predetermined distance M along the longitudinal direction.

Preferably, the resilient member 44 includes a first resilient portion 64 and a second resilient portion 66. The first resilient portion 64 is abutted by a corresponding portion of the auxiliary member 36. For example, the corresponding portion can be formed on the first predetermined portion 48 of the auxiliary member 36. The second resilient portion 66 is abutted by the engaging member 40.

Figure 5:
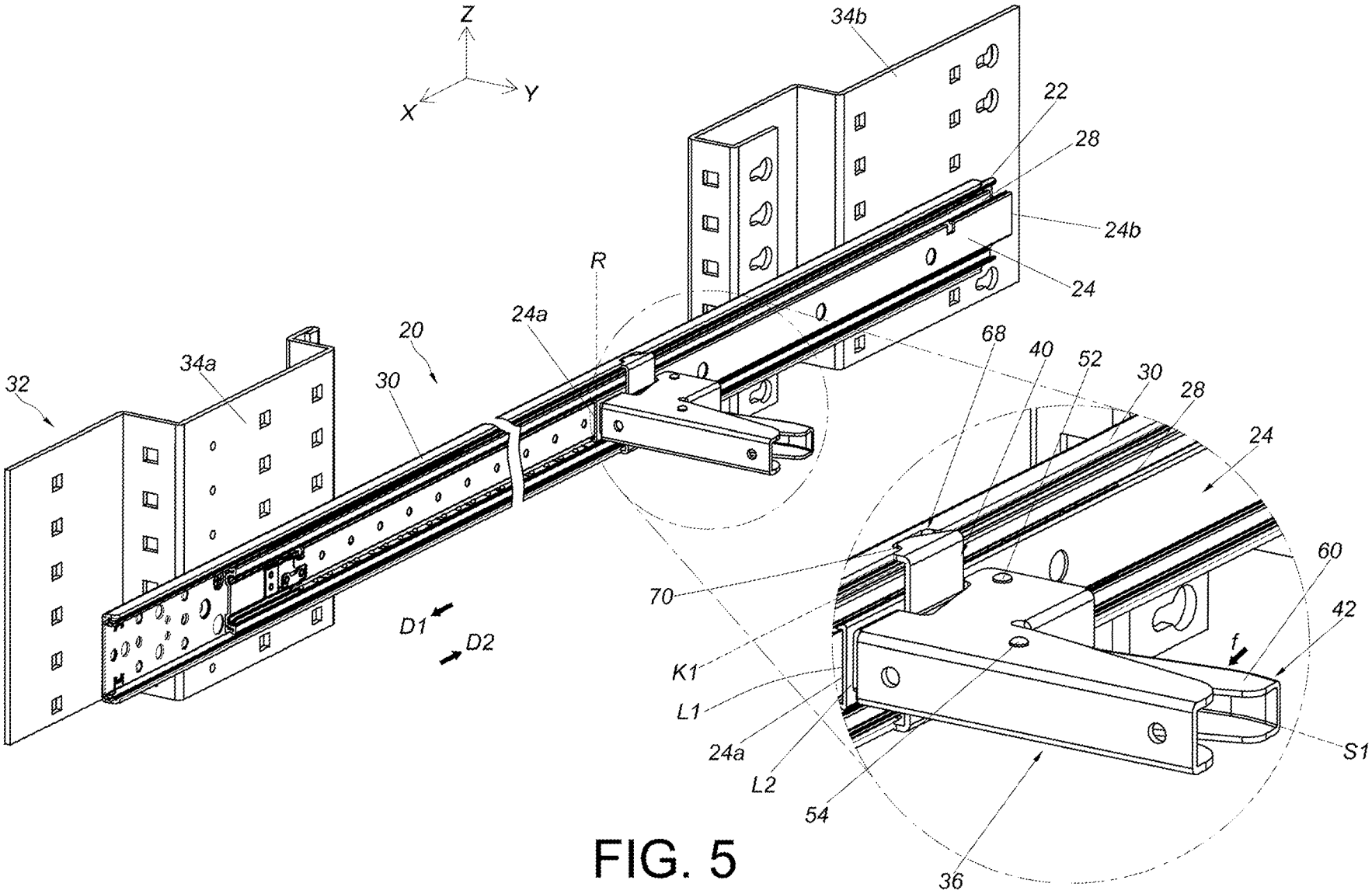
FIG. 5 is a diagram of the slide rail assembly as a second rail is prevented from displacing away from a predetermined position according to the first embodiment of the present invention.

As shown in FIG. 5, the operating member 42 is movably mounted on the auxiliary member 36 immovably mounted on the second rail 24, and therefore, the operating member 42 can be considered to be movably mounted on the second rail 24. Furthermore, the second rail 24 includes a first end portion 24*a* and a second end portion 24*b* opposite to the first end portion 24*a* along the longitudinal direction. For example, the first end portion 24*a* and the second end portion 24*b* of the second rail 24 can be a front end portion and a rear end portion of the second rail 24, respectively.

Preferably, the second rail 24 includes a first lateral side L1 and a second lateral side L2 opposite to the first lateral side L1 along the transverse direction. The first lateral side L1 of the second rail 24 is located adjacent to the first rail 22. The operating member 42 is located between the first end portion 24*a* and the second end portion 24*b* of the second rail 24 along the longitudinal direction and located adjacent to the second lateral side L2 of the second rail 24.

Preferably, the operating member 42 is located more adjacent to the first end portion 24*a* of the second rail 24 than the second end portion 24*b* of the second rail 24, and the operating member 42 does not protrude from the first end portion 24*a* of the second rail 24 along the longitudinal direction.

Preferably, an axial direction of the first shaft member 54 is substantially parallel to a height direction of the second rail 24, e.g., the Z axis, and an axial direction of the second shaft member 52 is also substantially parallel to the height direction of the second rail 24.

The slide rail assembly 20 further includes a blocking feature 68 arranged on the first rail 22. In this embodiment, by way of example, the blocking feature 68 is arranged on the supporting bracket 30 fixedly connected to the first rail 22, and the blocking feature 68 can be considered to be arranged on the first rail 22 because the supporting bracket 30 can be considered as a part of the first rail 22. However, the present invention is not limited to this embodiment.

When the second rail 24 is located at a predetermined position, e.g., a retracted position R, relative to the first rail 22, the engaging member 40 in the engaging state K1 is blocked by the blocking feature 68 for preventing a displacement of the second rail 24 from the retracted position R along a first direction D1 or a second direction D2 opposite to the first direction D1. In this embodiment, by way of example, the first direction D1 and the second direction D2 can be an opening direction and a retracting direction, respectively. However, the present invention is not limited to this embodiment.

Figure 6:
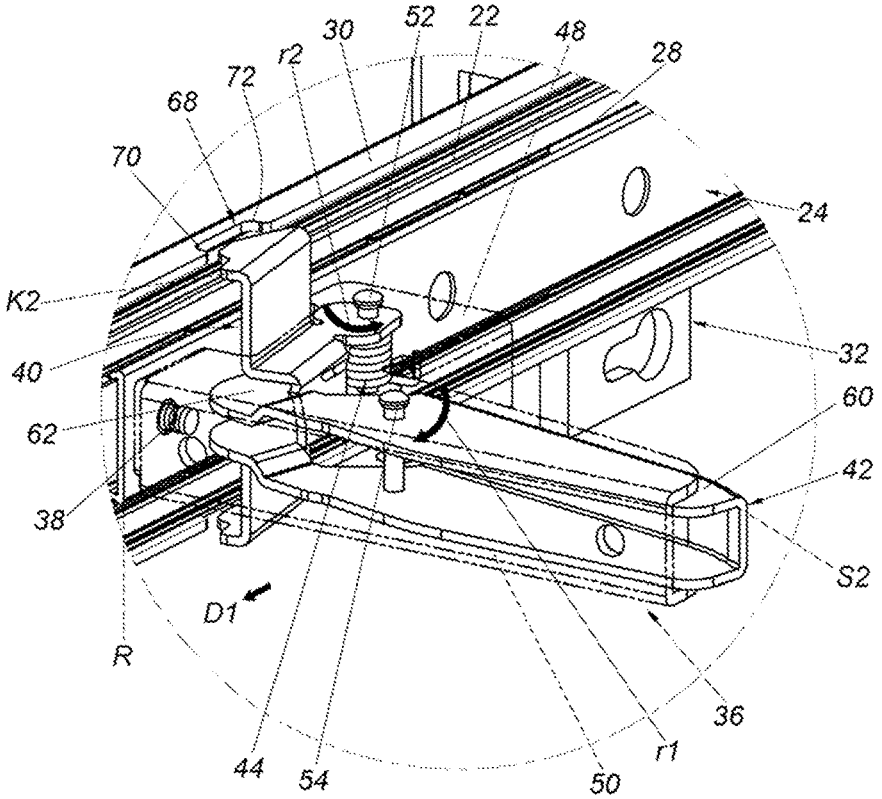
FIG. 6 is a diagram of the slide rail assembly as the second rail is allowed to displace away from the predetermined position according to the first embodiment of the present invention.
Figure 7:
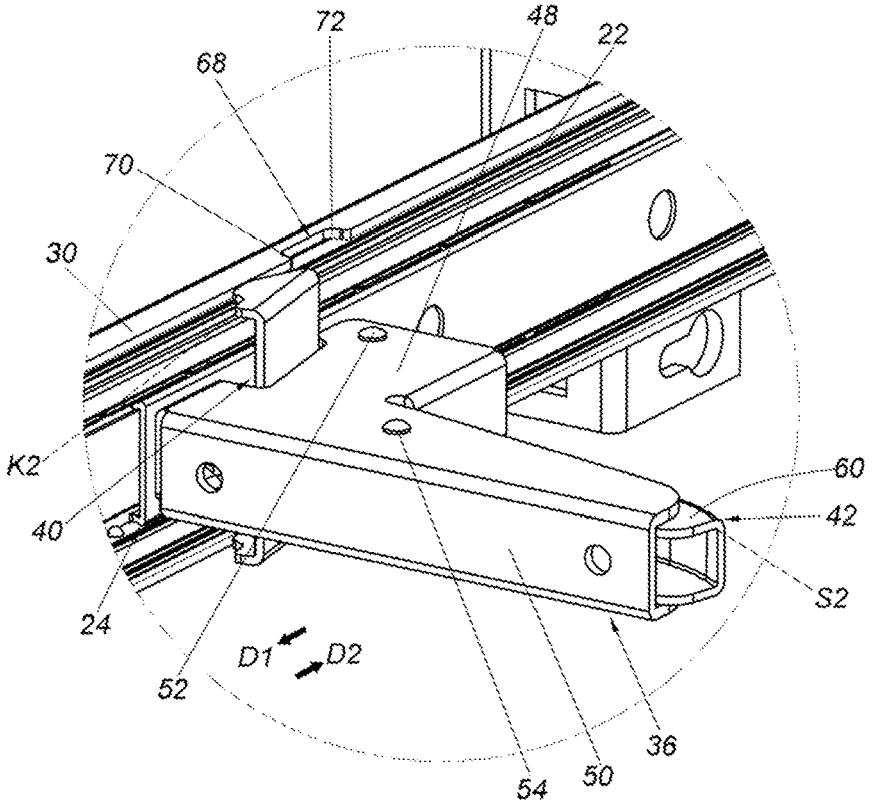
FIG. 7 is a diagram of the slide rail assembly as the second rail has been displaced away from the predetermined position along a first direction according to the first embodiment of the present invention.

As shown in FIG. 6 and FIG. 7, the operating member 42 is configured to drive the engaging member 40 to move relative to the first rail 22 and/or the supporting bracket 30, such that the engaging member 40 is not blocked by the blocking feature 68 for allowing the displacement of the second rail 24 from the retracted position R along the first direction D1 or the second direction D2.

For example, the operating portion 60 of the operating member 42 can be operated by overcoming the resilient force F provided by the resilient member 44, so as to move the operating portion 60 toward the second predetermined portion 50 of the auxiliary member 36 for driving the operating member 42 to move from the first state S1 to a second state S2 along a first pivoting direction r1, such that the engaging member 40 is driven by the driving portion 62 of the operating member 42 to move from the engaging state K1 to a disengaging state K2 along a second pivoting direction r2. When the engaging member 40 is in the disengaging state K2, the engaging member 40 is not blocked by a first blocking portion 70 and/or a second blocking portion 72 of the blocking feature 68, such that the second rail 24 is allowed to displace from the retracted position R as shown in FIG. 6 to a position as shown in FIG. 7 along the first direction D1. It should be noticed that when the engaging member 40 is in the disengaging state K2, the resilient member 44 is resiliently deformed to provide the resilient force F. In this embodiment, by way of example, the first pivoting direction r1 is opposite to the second pivoting direction r2. However, the present invention is not limited to this embodiment.

Preferably, a user can operate the operating portion 60 of the operating member 42 for driving the operating member 42 to move from the first state S1 to the second state S2 by holding the second predetermined portion 50 of the auxiliary member 36 and the operating portion 60 of the operating member 42 easily.

On the other hand, when the second rail 24 is displaced to the retracted position R from another predetermined position, e.g., an extended position, relative to the first rail 22 along the second direction D2, the operated portion of the operating member 42 can be released, such that the engaging member 40 can move from the disengaging state K2 to the engaging state K1 to be engaged and blocked by the blocking feature 68 in response to the resilient force F provided by the resilient member 44 for retaining the second rail 24 at the retracted position R relative to the first rail 22, i.e., preventing the displacement of the second rail 24 from the retracted position R relative to the first rail 22.

Figure 8:
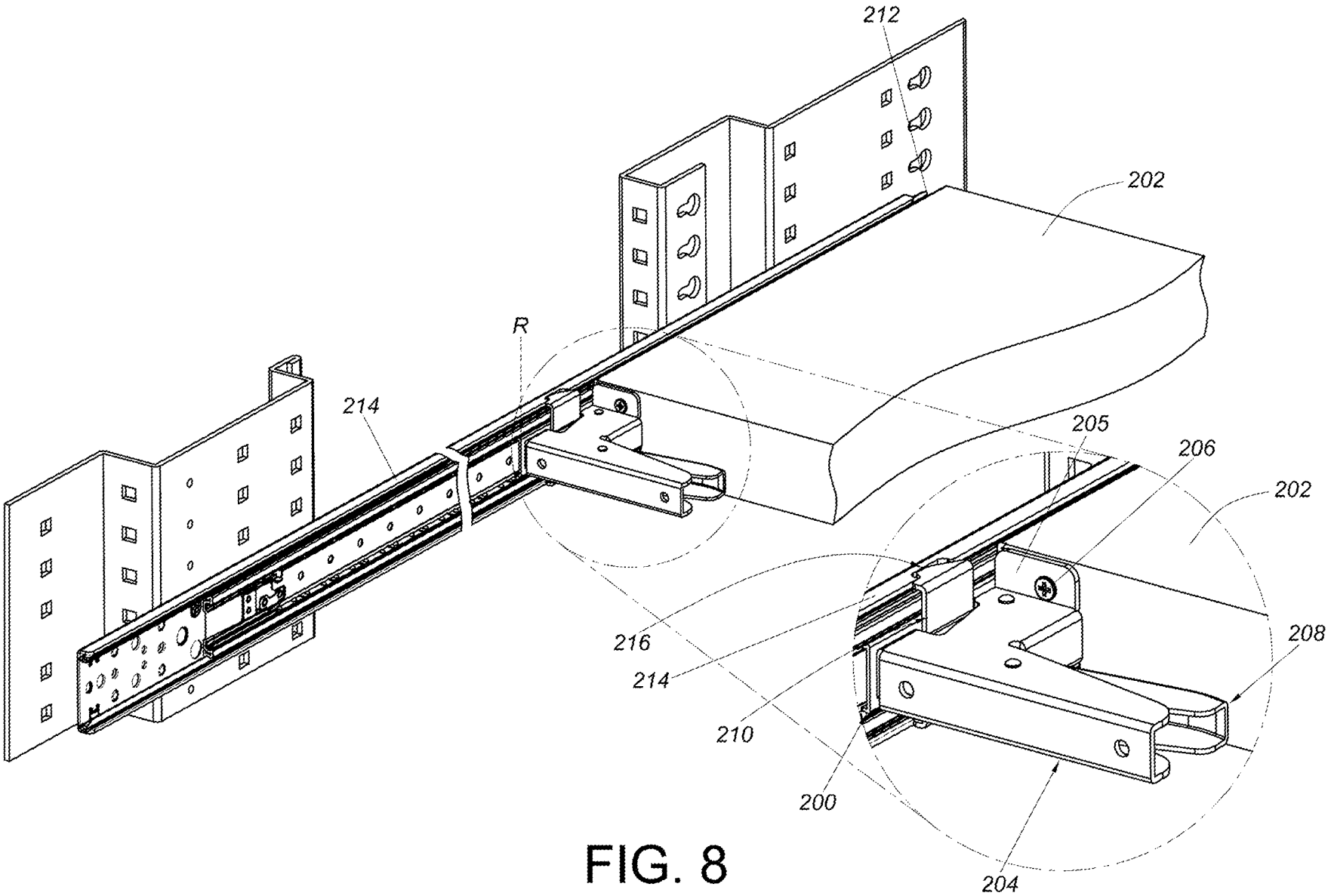
FIG. 8 is a diagram of a slide rail assembly according to a second embodiment of the present invention.

As shown in FIG. 8, in a second embodiment, a second rail 200 is displaceable relative to a first rail 212 and configured to support a carried object 202. A blocking feature 216 is arranged on a supporting bracket 214 fixedly connected to the first rail 212. Different from the first embodiment, an auxiliary member 204 is configured to be mounted on the carried object 202.

In this embodiment, by way of example, the auxiliary member 204 includes an extending portion 205 detachably mounted on the carried object 202 by at least one connecting member 206 in a fastening manner, and the auxiliary member 204 can be immovable relative to the carried object 202 so as to be considered as a part of the carried object 202 after the auxiliary member 204 is mounted on the carried object 202. However, the present invention is not limited to this embodiment. For example, in another embodiment, the auxiliary member can be detachably mounted on the carried object in an engaging manner, an inserting manner, a snapping manner or any other manner. Furthermore, an operating member 208 and an engaging member 210 are both movably mounted on the auxiliary member 204, and the operating member 208 and the engaging member 210 can be considered to be movably mounted on the carried object 202 because the auxiliary member 204 can be considered as a part of the carried object 202.

Other details of the second embodiment are the same as the ones of the first embodiment. Detailed description for is omitted herein for simplicity.

In conclusion, the present invention includes the following characteristics.

1. The operating member 42 or 208 is configured to drive the engaging member 40 or 210, such that the engaging member 40 or 210 is not blocked by the blocking feature 68 or 216 for allowing the displacement of the second rail 24 or 200 from the predetermined position, e.g., the retracted position R, relative to the first rail 22 or 212 along the first direction D1.

2. When the second rail 24 or 200 is displaced to the predetermined position, e.g., the retracted position R, from the another predetermined position, e.g., the extended position, relative to the first rail 22 or 212 along the second direction D2, the engaging member 40 or 210 can move from the disengaging state K2 to the engaging state K1 to be engaged and blocked by the blocking feature 68 or 216 in response to the resilient force F provided by the resilient member 44 for retaining the second rail 24 or 200 at the predetermined position relative to the first rail 22 or 212, i.e., preventing the displacement of the second rail 24 or 200 from the predetermined position relative to the first rail 22 or 212.

3. When the operating member 42 or 208 is in the first state S1 as shown in FIG. 3, the operating portion 60 of the operating member 42 or 208 is spaced away from the second predetermined portion 50 of the auxiliary member 36 or 204 at the predetermined distance M along the longitudinal direction. Such configuration allows the user to operate the operating portion 60 of the operating member 42 or 208 for driving the operating member 42 or 208 to move from the first state S1 to the second state S2 by holding the second predetermined portion 50 of the auxiliary member 36 or 204 and the operating portion 60 of the operating member 42 or 208 easily.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A slide rail assembly comprising:

a first rail;

a second rail displaceable relative to the first rail along a longitudinal direction, the second rail comprising a first end portion and a second end portion opposite to the first end portion along the longitudinal direction;

a blocking feature arranged on the first rail;

an engaging member;

a resilient member configured to provide a resilient force to the engaging member; and an operating member located between the first end portion and the second end portion of the second rail along the longitudinal direction and located adjacent to a lateral side of the second rail, the operating member being movably switchable between a first state and a second state;

wherein when the second rail is located at a retracted position relative to the first rail, the blocking feature blocks the engaging member applied with the resilient force provided by the resilient member for preventing a displacement of the second rail from the retracted position along a first direction;

wherein the operating member is configured to move from the first state to the second state along a first pivoting direction to drive the engaging member to move along a second pivoting direction opposite to the first pivoting direction, such that the engaging member is not blocked by the blocking feature for allowing the displacement of the second rail from the retracted position along the first direction.

2. The slide rail assembly of claim 1, further comprising an operating device, the operating device comprising the engaging member, the resilient member, the operating member and an auxiliary member, the auxiliary member being configured to be mounted on the second rail, and one of the engaging member and the operating member being movably mounted on the auxiliary member.

3. The slide rail assembly of claim 2, wherein the auxiliary member is detachably mounted on the second rail.

4. The slide rail assembly of claim 2, wherein the operating member is pivotally connected to the auxiliary member by a first shaft member, and an axial direction of the first shaft member is parallel to a height direction of the second rail.

5. The slide rail assembly of claim 4, wherein the engaging member is pivotally connected to the auxiliary member by a second shaft member, and an axial direction of the second shaft member is parallel to the height direction of the second rail.

6. The slide rail assembly of claim 5, wherein the auxiliary member comprises a first predetermined portion and a second predetermined portion, the first predetermined portion and the second predetermined portion are perpendicularly connected to each other and respectively extend along the longitudinal direction and a transverse direction perpendicular to the longitudinal direction, the operating member is pivotally connected to the second predetermined portion of the auxiliary member by the first shaft member, and the engaging member is pivotally connected to the first predetermined portion of the auxiliary member by the second shaft member.

7. The slide rail assembly of claim 1, further comprising an auxiliary member configured to be mounted on the second rail, the auxiliary member comprising a first predetermined portion and a second predetermined portion, the first predetermined portion and the second predetermined portion being perpendicularly connected to each other and respectively extend along the longitudinal direction and a transverse direction perpendicular to the longitudinal direction, the operating member being pivotally connected to the second predetermined portion of the auxiliary member by a first shaft member, an axial direction of the first shaft member being parallel to the height direction of the second rail, the operating member comprising an operating portion and a driving portion, the first shaft member being located between the operating portion and the driving portion, and the operating portion of the operating member in the first state extending along the transverse direction and being spaced away from the second predetermined portion of the auxiliary member at a predetermined distance along the longitudinal direction.

8. The slide rail assembly of claim 1, wherein the second rail comprises a first lateral side and a second lateral side opposite to the first lateral side along a transverse direction, the first rail is located adjacent to the first lateral side of the second rail, and the operating member is located adjacent to the second lateral side of the second rail.

9. The slide rail assembly of claim 1, further comprising a third rail movably mounted between the first rail and the second rail.

10. The slide rail assembly of claim 1, wherein the first rail comprises a supporting bracket configured to be mounted on a rack, and the blocking feature is arranged on the supporting bracket.

11. A slide rail assembly comprising:

a first rail;

a second rail displaceable relative to the first rail along a longitudinal direction and configured to support a carried object;

a blocking feature arranged on the first rail;

an engaging member movable relative to the first rail; and an auxiliary member configured to be mounted on one of the second rail and the carried object, the auxiliary member comprising a first predetermined portion and a second predetermined portion, the first predetermined portion and the second predetermined portion being perpendicularly connected to each other and respectively extending along the longitudinal direction and a transverse direction perpendicular to the longitudinal direction;

an operating member movably mounted on the auxiliary member, the operating member being movably switchable between a first state and a second state;

wherein when the second rail is located at a predetermined position relative to the first rail, the engaging member is blocked by the blocking feature for preventing a displacement of the second rail from a predetermined position along a first direction;

wherein the operating member is configured to move from the first state to the second state to drive the engaging member, such that the engaging member is not blocked by the blocking feature for allowing the displacement of the second rail from the predetermined position along the first direction;

wherein the operating member comprises an operating portion, the operating portion of the operating member in the first state extends along the transverse direction and is spaced away from the second predetermined portion of the auxiliary member at a predetermined distance along the longitudinal direction, and when the operating member moves from the first state to the second state, the operating portion of the operating member moves toward the second predetermined portion of the auxiliary member.

12. The slide rail assembly of claim 11, further comprising a resilient member configured to provide a resilient force to the engaging member.

13. The slide rail assembly of claim 12, wherein the engaging member is movably mounted on the auxiliary member.

14. The slide rail assembly of claim 13, wherein the operating member is pivotally connected to the auxiliary member by a first shaft member, and the engaging member is pivotally connected to the auxiliary member by a second shaft member.

15. The slide rail assembly of claim 14, wherein an axial direction of the first shaft member is parallel to a height direction of the second rail, and an axial direction of the second shaft member is parallel to the height direction of the second rail.

16. The slide rail assembly of claim 15, wherein the operating member is pivotally connected to the second predetermined portion of the auxiliary member by the first shaft member, and the engaging member is pivotally connected to the first predetermined portion of the auxiliary member by the second shaft member.

17. The slide rail assembly of claim 11, wherein the auxiliary member is configured to be mounted on the second rail, the operating member is pivotally connected to the second predetermined portion of the auxiliary member by a first shaft member, an axial direction of the first shaft member is parallel to the height direction of the second rail, the operating member further comprises a driving portion, and the first shaft member is located between the operating portion and the driving portion.

18. The slide rail assembly of claim 11, wherein the second rail comprises a first end portion and a second end portion opposite to the first end portion along the longitudinal direction, and the operating member does not protrude from the first end portion of the second rail along the longitudinal direction.

19. The slide rail assembly of claim 11, further comprising a third rail and a supporting bracket, the third rail being movably mounted between the first rail and the second rail, and the supporting bracket being arranged on the first rail and configured to be mounted on a rack.

* * * * *